US007954451B2

(12) United States Patent
Klein

(10) Patent No.: US 7,954,451 B2
(45) Date of Patent: Jun. 7, 2011

(54) CLOSED LOOP ADHESIVE REGISTRATION SYSTEM

(75) Inventor: Richard G. Klein, Avon Lake, OH (US)

(73) Assignee: Nordson Corporation, Westlake, OH (US)

( * ) Notice: Subject to any disclaimer, the term of this patent is extended or adjusted under 35 U.S.C. 154(b) by 619 days.

(21) Appl. No.: 12/046,797

(22) Filed: Mar. 12, 2008

(65) Prior Publication Data

US 2008/0149030 A1 Jun. 26, 2008

Related U.S. Application Data

(62) Division of application No. 10/984,073, filed on Nov. 9, 2004, now Pat. No. 7,364,775.

(51) Int. Cl.
*B05C 11/00* (2006.01)

(52) U.S. Cl. ..... 118/682; 118/702; 118/703; 118/708; 118/712; 118/66; 156/356; 156/357; 156/366

(58) Field of Classification Search ..... 118/682, 118/702, 703, 708, 712, 692, 699, 684, 686; 427/8, 424, 421, 427.2; 156/356, 357, 366; 222/644, 639

See application file for complete search history.

(56) References Cited

U.S. PATENT DOCUMENTS

| | | | |
|---|---|---|---|
| 4,500,937 | A | 2/1985 | Matt |
| 4,957,782 | A | 9/1990 | Medler et al. |
| 5,026,989 | A | 6/1991 | Merkel |
| 5,208,064 | A | 5/1993 | Becker et al. |
| 5,322,706 | A | 6/1994 | Merkel et al. |
| 5,380,366 | A | 1/1995 | Becker et al. |
| RE35,010 | E | 8/1995 | Price |
| 5,510,149 | A | 4/1996 | Schucker |
| 5,540,946 | A | 7/1996 | DeVries et al. |
| 5,683,752 | A | 11/1997 | Popp et al. |
| 5,920,829 | A | 7/1999 | Bretmersky et al. |
| 5,922,132 | A | 7/1999 | Martel |
| 6,190,727 | B1 | 2/2001 | Thaggard |
| 6,299,931 | B1 | 10/2001 | Leary et al. |
| 2002/0079325 | A1 | 6/2002 | Estelle |
| 2003/0080159 | A1 | 5/2003 | Estelle |

*Primary Examiner* — Yewebdar T Tadesse

(74) *Attorney, Agent, or Firm* — Wood, Herron & Evans, LLP

(57) ABSTRACT

An apparatus and method use closed loop control processes to automatically adjust a command signal used to change an operating state of a fluid dispensing gun. Proportional, integral and/or derivative control processes are used to determine an operating parameter comprising on time compensation, off time compensation and/or a fluid pressure compensation. An adjustment is made to the operating parameter if a number of consecutive measurements of an adhesive bead characteristic are outside of a predetermined tolerance range. A sensor for producing a feedback signal is used to communicate a measurable difference between an actual and a desired bead characteristic. The feedback signal applied in real time is used when determining the operating parameter, reducing substrate waste and increasing efficiency.

17 Claims, 6 Drawing Sheets

CLOSED LOOP ADHESIVE REGISTRATION SYSTEM

CROSS-REFERENCE TO RELATED APPLICATIONS

This application is a divisional of U.S. patent application Ser. No. 10/984,073, filed Nov. 9, 2004 (now U.S. Pat. No. 7,364,775), the disclosure of which is hereby incorporated by reference herein.

FIELD OF THE INVENTION

The present invention generally relates to a liquid dispenser and a method for dispensing fluids, and more specifically, to a fluid dispenser having an automatic compensation that improves performance.

BACKGROUND OF THE INVENTION

The ability to precisely dispense a fluid, for example, a hot melt or cold adhesive or glue, is a necessity for manufacturers engaged in the packaging and plastics industries. Various fluid dispensers have been developed for the placement of fluids, for example, adhesives, coatings, etc., onto a substrate, for example, a carton flap, being supported by a moving conveyor. The speed of the conveyor, or line speed, is set according to such factors as the complexity of the dispensing pattern and the configuration of the gun. Adhesive is normally supplied to the dispensing gun under pressure by a motor driven pump. In such applications, and particularly during startup and shutdown, it is important that fluids be dispensed and applied at precise locations or positions on the moving substrate. Fluid that is dispensed too soon or too late and therefore dispensed at other than a desired location can adversely impact subsequent operations on the product and/or result in a lower quality or scrap product.

The time required to open and close the fluid dispensing gun, that is, the dispensing gun switching time, creates a delay in the fluid dispensing process that can cause inaccuracies in the fluid dispensing process. For example, a conveyor moving at 500 feet per minute will move 0.008 inches in one millisecond. If a pneumatic solenoid-operated dispensing gun takes 25 ms to open, the substrate will have moved 0.200 inches after the dispensing gun is commanded to open, but before any fluid is dispensed from the dispensing gun. Thus, the adhesive is deposited onto the substrate at a different location than anticipated, and such shifts in the location of the adhesive reduces the quality of the fluid dispensing process and may result in scrap product.

The quality of the fluid dispensing process is also adversely affected by variations in the dispensing gun switching time when the dispensing gun is commanded to close. At the end of a dispensing process, a lengthening of the switching time of the dispensing gun results in adhesive being dispensed for a longer period of time than desired and hence, at a different location than anticipated. Similarly, a shortened switching time can result in a lower quality fluid dispensing process and a scrap part or product.

In order to improve the speed and reliability of the fluid dispensing process, more recent years have seen the development of an electrically operated fluid dispenser or gun. Generally, electrically operated fluid dispensers have an electromagnetic coil surrounding an armature that is energized to produce an electromagnetic field with respect to a magnetic pole. The electromagnetic field is selectively controlled to open and close a dispensing valve by moving a valve stem connected to the armature. More specifically, the forces of magnetic attraction between the armature and the magnetic pole move the armature and valve stem toward the pole, thereby opening the dispensing valve. At the end of a dispensing cycle, the electromagnet is de-energized, and a return spring returns the armature and valve stem to their original positions, thereby closing the dispensing valve. By operating a dispensing gun coil at higher voltages, for example, over 40 VAC, the operational speed of the electric fluid dispensing gun is increased.

However, even with a greater speed of operation, a finite period of time, for example, ten milliseconds, is required to energize a magnetic field with the gun coil and move the valve to its open position. That period of time represents a delay in the application of fluid onto the moving substrate. Depending on the conveyor speed, that short delay also causes inaccuracies in the desired placement of fluid on the substrate.

There is a continuing market pressure to provide faster conveyor speeds, for example, 1,000 feet per minute and more, without any loss of quality in the fluid dispensing process. Clearly, as conveyor speeds increase, the effect of variations in the gun switching time becomes more important. Controls for fluid dispensing guns consequently have a manually adjustable input that is used by an operator to provide a fixed, gun on compensation value. For example, the gun coil switching time can be measured and used as a compensation value that is entered by the operator before initiating a fluid dispensing cycle. The gun control uses the gun on compensation value to advance a start of a fluid dispensing cycle, that is, the time at which the gun coil is turned on or energized. Thus, after the delay caused by the gun coil switching time, fluid is dispensed from the gun at a time that results in a more accurate deposition of fluid onto the substrate.

In many applications, that fixed compensation value provides a satisfactory fluid dispensing process. However, in some applications, the operator may observe that the placement of the fluid is not accurate. In those applications, the operator can again use the manually adjustable input to change the compensation value and thus, more accurately locate the placement of the fluid on the substrate.

The same issues arise when the fluid dispensing gun is turned off. It should be noted that the fluid dispensing valve is opened by operation of the gun coil, whereas the fluid dispensing valve is closed by the operation of a return spring. Therefore, the switching times required to open and shut the fluid dispensing valve are often different. The increment of time required for the magnetic field in the gun coil to dissipate and the return spring to shut off the valve is measurable and can be manually input into the fluid dispensing control as a fixed, gun off compensation value. The gun control uses that compensation value to advance an ending of the fluid dispensing cycle, that is, the time at which the gun coil is turned off or de-energized. Thus, after the delay to shut the dispensing valve off, fluid ceases to be dispensed from the gun at a time that results in an accurate termination of the fluid dispensing process.

Although known fluid dispensing systems operate satisfactorily in many applications, the dispensing gun switching time can be adversely impacted by many different factors. For example, variations in the switching time of the dispensing gun can be caused by variations in fluid viscosity or variations in line voltage being supplied to the dispensing system control. Further, mechanical wear and aging of components within the dispensing gun can impact gun switching time. For example, a return spring is often used to move the dispensing valve in opposition to a solenoid. Over its life, the spring constant of the return spring changes, thereby changing the rate at which the dispensing valve opens and closes and hence, the location of dispensed adhesive on a substrate. Further, the accumulation of charred adhesive within the dispensing gun over its life often increases frictional forces on the dispensing valve, thereby changing gun actuation time. Thus, for the above and other reasons, the operation of the dispensing gun is subject to many changing physical forces and environmental conditions that cause variations in the actuation time of the dispensing gun. Such variations in dispensing gun switching times produce variations from desired locations of adhesive deposits on the moving substrate.

Thus, known compensation techniques for fluid dispensing systems have several disadvantages. First, if the initial compensation value is not accurate, a better compensation value requires that production be run in a trial and error process until the desired compensation is determined. Such a process is an inefficient and uneconomical use of the production line, and scrap product is often being produced during this tuning process. Second, if, during production, there are any changes in the components of the fluid dispensing gun that change its operating time, the placement of the fluid on the substrate will drift. Any drift in the switching time of the fluid dispensing gun often results in a less accurate fluid dispensing process and hence, a poorer quality product.

The applicator may apply the treatment and the location other than the desired location due to changes in operating conditions. For instance, where the applicator is a glue applicator, glue valve delay, or changes in glue pressure or consistency may cause the glue to be applied to a carton at a location other than the desired location. The operator must measure the applied location of the treatment, and reset the applicator until the applied location matches the desired location. This is a time consuming process that requires several repetitions and reduces productivity.

Thus, there is need for a fluid dispensing system that automatically corrects for any variations in the switching time of the fluid dispensing gun.

SUMMARY OF THE INVENTION

The present invention provides an improved fluid dispensing system configured to automatically compensate for switching and other delays associated with a dispensing process. To this end, the system uses control processes to automatically adjust a command signal used to change an operating state of a fluid dispensing gun. For example, the system may use a proportional, an integral and/or a derivative control process to determine an operating parameter comprising the control signal. Such an operating parameter may include, for instance, an on time compensation value, $X_{on}$. $X_{on}$ corresponds to the distance of the substrate up line from the glue gun at which the gun should initiate processes for applying the adhesive, or change its state, in order for the adhesive to be placed properly on the substrate. This $X_{on}$ determination is used by the control to affect bead placement on a next-occurring cycle. Other operating parameters may include off time compensation, $X_{off}$, as well as the volume or fluid pressure of the dispensed adhesive.

An adjustment may be made to the operating parameter, e.g., $X_{on}$, $X_{off}$ and fluid pressure, if ω consecutive measurements of an adhesive bead characteristic are outside of a predetermined tolerance range. A portion of the adjustment to the operating parameter (and control signal) is determined by a product of a summation of those ω consecutive errors and the parameter control value. The control value may include a gain term of 0.002, for instance. If there are not ω consecutive out of tolerance errors, then the operating parameter remains the same. The tolerance and ω are typically determined experimentally.

An integral control term is also included when the adjustment is made, and it is equal to the product of the summation of the total error of the control variable and the control gain term. This integral control feature reduces steady state error of the operating parameter.

An adjustment to the operating parameter may also be made to compensate for changes in conveyor speed. This adjustment is made for every substrate, and includes the product of the change in speed multiplied by an estimated on or off time, as appropriate.

A sensor for producing a feedback signal is used to communicate a measurable difference between an actual and a desired bead characteristic. Such characteristics may include, for example, a distance from an edge of a substrate to the start of a bead, as well as the length and volume of the bead. The system uses the feedback signal when determining the operating parameter. For instance, the system compares the measurable difference to the tolerance range and uses the measurable difference in calculations used to determine the operating parameter. This feature thus provides for the adjustment of $X_{on}$, $X_{off}$ and/or adhesive pressure in real time. The real time adjustment translates into less wasted substrate and other more efficient processing.

In this manner, features of the system automatically provide a more accurate fluid dispensing process. The fluid dispensing system continuously monitors the operation of the fluid dispensing gun and accordingly adjusts the dispensing process so that fluid is accurately dispensed onto the substrate. Thus, the fluid dispensing system of the present invention automatically and consistently dispenses fluid at a desired location on a moving substrate independent of changes in the switching times of the dispensing gun that would otherwise adversely impact the quality of the fluid dispensing process.

The capability of automatically monitoring and compensating for changes in the gun switching time also permits a wider variety of fluid dispensing guns to be used to accurately dispense fluid onto a moving substrate. For example, with the present invention, fluid dispensing guns having slower gun switching times can be used to more accurately dispense fluid onto a moving substrate. Slower switching fluid dispensing guns are often less expensive, and therefore, the present invention has a further advantage of obtaining a higher quality fluid dispensing process from a lower cost fluid dispensing system.

These and other objects and advantages of the present invention will become more readily apparent during the following detailed description taken in conjunction with the drawings herein.

DETAILED DESCRIPTION OF THE INVENTION

Figure 1:
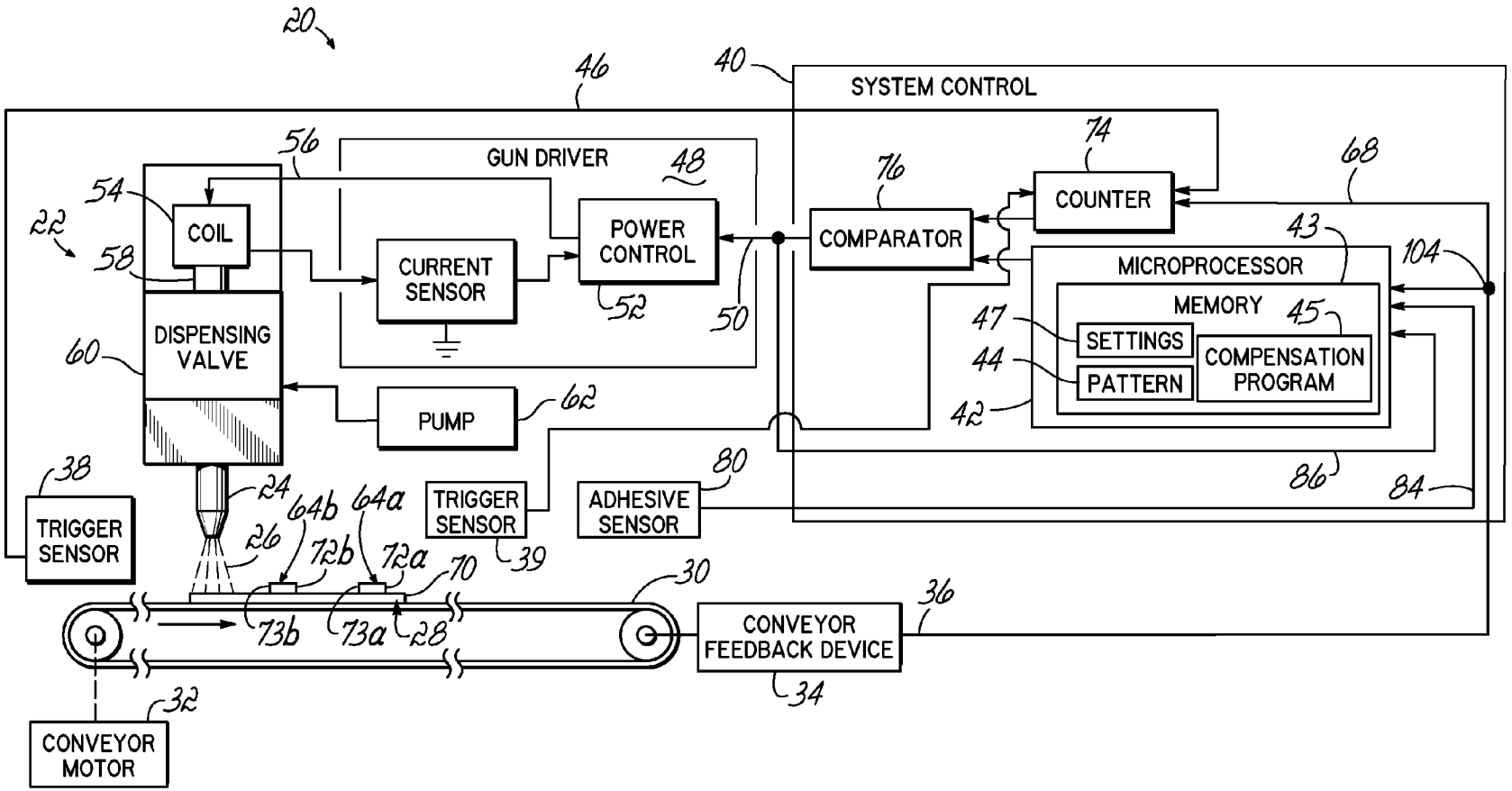
FIG. 1 is a block diagram of a fluid dispensing system having a compensation system in accordance with the principles of the present invention.

FIG. 1 shows a block diagram of a fluid dispensing system 20 configured to automatically compensate for irregularities and changing operating conditions as a gun 22 dispenses adhesive 26 onto a conveyed substrate 28. Namely, the system 20 automatically adjusts a command signal used to change operating states of a fluid dispensing gun 22, i.e., off and on, according to a measured adhesive characteristic. In one sense, the system 20 is configured to automatically determine an operating parameter used to generate the command signal. Such an operating parameter may include, for instance, an on time compensation value, $X_{on}$.

$X_{on}$ corresponds to the distance of the substrate up line from the glue gun 22 at which the gun 22 should initiate processes for applying the adhesive 26, or change its state, in order for the adhesive 26 to be placed properly on the substrate 28. This $X_{on}$ determination is used by a system control 40 to affect adhesive bead placement on a next occurring cycle. Other operating parameters may include off time compensation, $X_{off}$, as well as the volume or pressure of the dispensed adhesive 26.

To this end, an adhesive sensor 80 of the system 20 may detect an adhesive characteristic. Such a characteristic may include positional characteristics, or characteristics relating to the position of the adhesive, such as a distance from the leading edge 72 of a substrate to the start of an adhesive bead, as well as in certain embodiments, the length of a bead. A suitable characteristic in another embodiment includes the volume of the bead. These measurements are compared to desired values and adjustments are made accordingly to $X_{on}$, $X_{off}$, and/or fluid pressure. In this sense, system 20 achieves real time feedback that reduces substrate waste and increases efficiency.

Referring more particularly to FIG. 1, the fluid dispensing gun 22 comprises a nozzle 24 for dispensing a fluid 26, for example, a hot melt or cold adhesive or glue, onto a part or substrate 28. A conveyor 30 of the system 20 carries the substrate 28 past the dispensing gun 22. The conveyor 30 is mechanically coupled to a conveyor drive having a conveyor motor 32. An exemplary conveyor speed may include 300 meters per minute. One skilled in the art, however, will appreciate that conveyor speeds may vary dramatically per different application specifications.

A conveyor feedback device 34, for example, an encoder, resolver, etc., is mechanically coupled to the conveyor 30 and detects conveyor motion. An incremental encoder, for instance, creates a series of square waves in response to conveyor activity. The number of square waves can be made to correspond to the mechanical increment required. For example, to divide a shaft revolution into one thousand parts, an encoder could be selected to supply one thousand square wave cycles per revolution. By using a counter 74 to count those cycles it is possible to know how far a shaft rotates. For instance, one hundred counts would equal 36°. In this manner, the feedback device 34 produces signals proportional to distance.

The feedback device 34 thus includes an output 36 providing a feedback signal that changes as a function of changes in the conveyor position. As discussed herein, the feedback signal typically provides a discrete pulse for each incremental displacement of the conveyor 30. The conveyor feedback device 34 thus may be used by the system control 40 to determine the position of the substrate for purposes of determining $X_{on}$ and $X_{off}$, for instance. While only one conveyor feedback device 34 is shown in FIG. 1, one skilled in the art will appreciate that two or more such devices may alternatively be used.

The system control 40 generally functions to coordinate the operation of the overall fluid dispensing system 20. For example, the system control 40 typically controls the operation of the conveyor motor 32 and also provides a system user input/output interface (not shown) in a known manner. Further, the system control 40 manages the fluid dispensing gun 22 as a function of a particular application and/or part being run.

The system control 40 receives, on an input 46, a part present or trigger signal from a trigger sensor 38. The trigger sensor 38 is positioned to detect a feature, for example, a leading edge, of the substrate 28 moving on the conveyor 30. For instance, the trigger sensor 38 may detect the leading edge of a carton flap. This trigger sensor 38 feature thus provides a mechanism for synchronizing substrate position determination and other operations with the motion of the conveyor 30. Down line trigger sensor 39 may similarly detect the leading edge of the substrate 28. Detection by the down line sensor 39 is accomplished prior to measurements of applicable characteristics are accomplished by the adhesive sensor 80. Either or both of the trigger sensors 38, 39 may comprise photocells or other proximity sensors.

A power control 52 within a gun driver 48 is responsive to the command (gun ON/OFF transition) signals and provides output signals to a dispensing gun coil 54 via an output 56. The transition time of the power control 52 is generally very small when compared to the switching time of the fluid dispensing gun 22. In any case, the system 20 automatically compensates for this switching delay, in addition to that of the gun 22 and any other system and environment delays in aggregate by virtue of the system control 40 adjusting the operating parameters in real time based on the actual adhesive placement.

The output signals energize and de-energize the gun coil 54 to operate the dispensing gun 22 as a function of the timing and duration of the command signals from the system control 40. Thus, the output signals also command or cause the dispensing gun 22 to change states. The dispensing valve 60 is fluidly connected to a pump 62. The pump 62 receives fluid, for example, an adhesive, from a reservoir (not shown). Upon the dispensing valve 60 opening, pressurized adhesive in the dispensing gun 22 passes through the nozzle 24 and is applied to the substrate 28 as a fluid deposit 64, for example, a dot, bead, strip, etc.

The dispensing valve 60 may remain open for the duration of the ON transition command signal, and in response to a subsequent OFF transition command signal, the gun driver 48 terminates current flow through the gun coil 54. The magnetic field around the armature 58 collapses, and the dispensing valve 50 is closed by a return spring (not shown) in a known manner.

A memory 43 of the microprocessor 42 of the system control 40 stores a fluid dispensing pattern 44. The fluid dispensing pattern 44 represents a series of fluid dispensing cycles associated with a substrate 28 that result in a desired pattern of fluid deposits 64 thereon. The fluid dispensing pattern 44 is often represented by numerical quantities or values in the pattern store 66 that are a measure of distances on the substrate 28 from a feature such as its leading edge 70 to leading and trailing edges 72, 73, respectively, of a fluid deposit 64.

The memory 43 also includes a compensation program 45. The microprocessor 42 executes the compensation program 45 to automatically determine an operating parameter. An exemplary such parameter may include a compensation distance, $X_{on}$. $X_{on}$ corresponds to the distance from the glue gun 22 at which the gun 22 should initiate processes for applying the adhesive in order for the adhesive to be placed properly on the substrate 28. As noted herein, the timing mechanism built into the $X_{on}$ determination accounts for and otherwise accommodates the finite time required to open the dispensing valve 60 and apply fluid 26 as a leading edge 72*a* of the deposit 64*a* on the moving substrate 28.

A counter 74 in communication with the microprocessor 42 is electrically connected to the conveyor feedback device 34 and the trigger sensor 38. The counter 74 accumulates a numerical value representing motion of the substrate 28, e.g., after its leading edge 70 has been detected by the trigger sensor 38.

A comparator 76 is responsive to a first numerical value from the microprocessor 42 representing the on time compensation position, $X_{on}$. Thus, the comparator 76 may be responsive to the leading edge 70 of the substrate 28. Accordingly, the comparator 76 is responsive to a second numerical value in the counter 74 representing motion of the substrate 28 after its leading edge 70 has been detected. When the comparator detects a relationship between those two values, for example, a substantial equality, a gun ON transition command signal is provided to the gun driver 48. The gun driver 48 turns on or opens the fluid dispensing gun 22, and fluid is deposited onto the substrate 28.

The counter 74 continues to count the feedback pulses from the conveyor feedback device 34, and the microprocessor 42 uses the stored pattern 66 to present the next stored value to the comparator 76. That next value determines a position of the substrate 28 or adhesive on the substrate 28 where the fluid dispensing gun 22 should be turned off, $X_{off}$. This off time compensation distance, $X_{off}$, corresponds to the distance of the substrate up line from the glue gun 22 at which the gun 22 should initiate processes for halting dispensing of the adhesive in order for the adhesive to be placed properly on the substrate 28. For instance, $X_{off}$ may represent the compensated location of the trailing edge 73*a* of the first fluid deposit 64*a* as measured from the leading edge 70 of the substrate 28. When the comparator 76 detects a relationship between those two quantities, for example, a substantial equality, a gun OFF transition command signal is provided the gun driver 48. The gun driver 48 causes the fluid dispensing gun 22 to shut off or close, thereby terminating the dispensing of fluid onto the moving substrate 28.

As discussed herein, the fluid dispensing system 20 of FIG. 1 has a compensation feature that includes an adhesive sensor 80. The adhesive sensor 80 is mounted with respect to the conveyor 30 so that the adhesive sensor 80 can measure characteristics that include the distance from the leading edge of the substrate to the start of the bead, as well as in some cases the length and/or volume of the bead. For instance, the adhesive sensor 80 may provide a sensor feedback signal representative of one or more edges 72, 73 of respective adhesive deposits 64 as the conveyor 30 moves the substrate 28.

The adhesive sensor 80 may thus comprise any sensor capable of reliably measuring one or more characteristics and may include, for example, an infrared sensor, dielectric sensor, laser sensor, etc. For instance, an adhesive sensor 80 may use capacitance to determine distances and volume. As such, the adhesive sensor 80 measures a change in a dielectric constant when a water-based adhesive enters a region between two plates included in the sensor 80.

In use, an operator enters a particular pattern 44 of fluid deposits 64*a* and 64*b* utilizing the system control 40. The pattern 44 is stored within memory 43. The operator then, via the system control 40, commands the conveyor motor 32 to start, thereby moving the substrate 28 on the conveyor 30 toward the fluid dispensing gun 22. When the trigger sensor 38 detects the leading edge 70 of the substrate 28, a trigger signal is provided to the counter 74. The counter 74 then begins to accumulate pulses from the conveyor feedback device 34 and thus, the counter 74 accumulates a numerical value representing the displacement of the conveyor 30 with respect to the leading edge 70 of the substrate 28.

The stored pattern 66 presents a first numerical value to the comparator 76 representing the distance from the leading edge 70 of the substrate 28 to the leading edge 72*a* of the first deposit 64*a*. The system control 40 processes this pattern according to the compensation method discussed below to determine an operating parameter. One such parameter may comprise $X_{on}$.

When the comparator 76 determines that the substrate 28 has moved through a displacement substantially equal to the first numerical value corresponding to $X_{on}$, the comparator 76 provides a gun on/off pulse, that is, a gun ON transition to the power control 52. The system control 40 via the power control 52 thus initiates a command signal that energizes and changes the state of the gun coil 54. The signal from the gun driver 48 creates current flow through the gun coil 54, thereby building up a magnetic field that lifts an armature 58 and a dispensing valve 60 connected thereto. As noted herein, the timing mechanism built into the $X_{on}$ determination accounts for and otherwise accommodates the finite time required to open the dispensing valve 60 and apply a fluid 26 as a leading edge 72*a* of the deposit 64*a* on the moving substrate 28.

The system 20 uses closed loop, or process control techniques, to determine to automatically adjust an operating parameter, e.g., $X_{on}$, of the command signal. More particularly, the system control 40 uses PID (Proportional, Integral, and/or Derivative) control processes to adjust the command signal. With proportional control, output is proportional to the error. More particularly, the control amplifies measured error and applies gain that is proportional to the error. An embodiment of the present invention combines processing features of proportional control with those of integral control. With integral control processes, the control effectively eliminates any offset associated with the proportional control processes.

In integral control, the signal used adjust the command signal is derived, in part, by integrating the error in the system. Output is consequently proportional to the amount of time the error is present. Integral control processes thus use a relatively large window to average out the error, and the proportional component provides response speed and stability. In an embodiment that uses derivative control, the output is proportional to the rate of change of the error.

Such features reduce the time to set up the gun compensation times for the desired positioning of a bead. This reduction in set up time increases the run time of the machine. Features of the present invention also maintain the registration of a pattern in the face of a machine parameter variation, including gun on-time/off-time, machine speed, etc. This registration control reduces down time and wasted product associated with manually retuning a conventional system.

Figure 2:
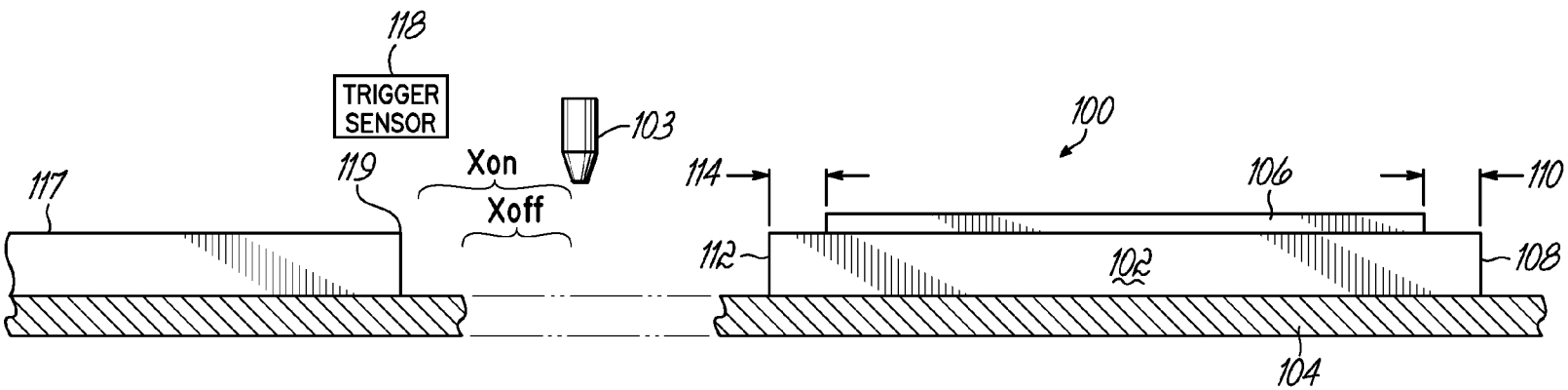
FIG. 2 is a block diagram of adhesive on a substrate supported on a conveyor belt.

The system 100 of FIG. 2 includes substrate 102, such as a carton, riding a conveyor belt 104. Substrate 102 is down line with respect to a dispensing gun 103. An adhesive bead 106 has been applied to the top surface of the substrate 102. The bead length shown in FIG. 2 comprises 120 mm, for instance. The bead 106 is set back from a leading edge 108 of the substrate 102 by a leading edge distance 110. A desired leading edge distance 110 may be 5 mm. The bead 106 is set back from a trailing edge 112 of the substrate 102 by a trailing edge distance 114. The trailing edge distance shown in FIG. 2 may be 6 mm. One skilled in the art, however, will appreciate that various other leading and trailing edge distances may be set per manufacturer specifications and requirements.

FIG. 2 also shows a substrate 117 that is up line with respect to the dispensing gun 103. As discussed herein, a trigger sensor 118 detects, for instance, the leading edge 119 of the substrate. The detection initiates counting of encoder pulses to determine the position of the leading edge 119 with respect to the dispensing gun 103. In so doing, the system 100 determines when the leading edge 119 is a distance, $X_{on}$ and/or $X_{off}$ from the gun 103. One skilled in the art will appreciate that $X_{on}$ and $X_{off}$ are not drawn to scale in FIG. 2, and that a typical $X_{on}$ distance may be around 125 mm, while a typical $X_{off}$ distance may be around 5 mm.

Figure 3:
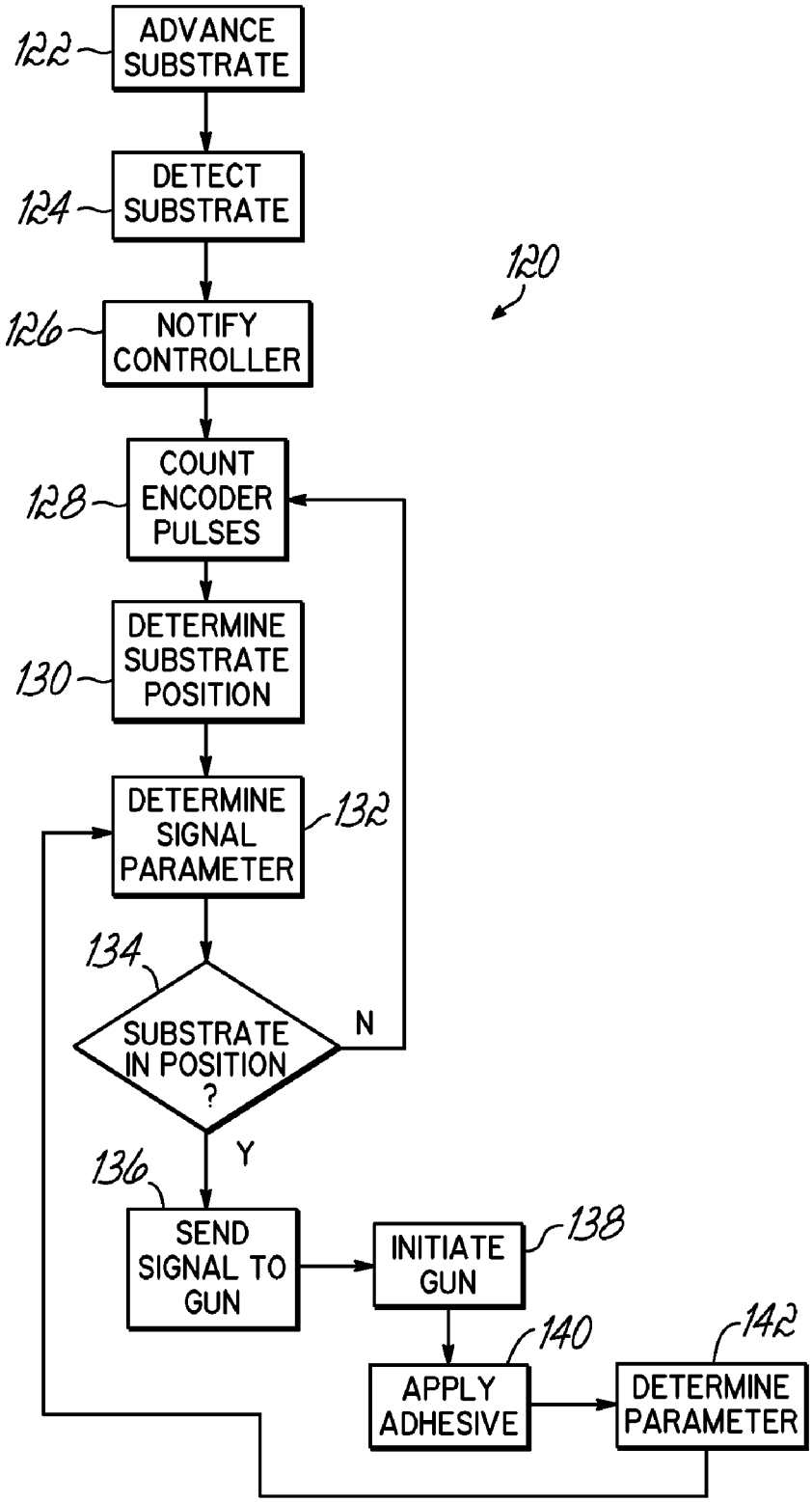
FIG. 3 is a flowchart having steps executable by the system of FIG. 1 that include a feedback loop used to automatically determine on time, off time and/or pressure compensation.

FIG. 3 is a flowchart 120 that shows a feedback loop used to automatically determine and adjust $X_{on}$, $X_{off}$ and/or adhesive pressure for system compensation considerations. Such compensation may be necessary for line speed, specification and equipment variations as discussed above. At block 122 of FIG. 3, the substrate 28 advances along the conveyor belt 30. The advancement of the substrate 28 is detected by the trigger sensor 38 at block 124 of FIG. 3. Such detection may occur, for example, when the substrate 28 is one meter away from the dispensing gun 22.

The processes of FIG. 3 may presume that different settings and operating processes have initialized. For instance, the system control 40 may have already had input and/or have recalled initial $X_{on}$, $X_{off}$ and/or a pressure operating parameters. The conveyor belt 30 may already be up to speed at block 122, or alternatively, the conveyor belt 30 may be just starting up at some intermediary speed leading up to full speed at block 122.

The trigger sensor 38 notifies the system control 40 at block 126 as to the detected position of the substrate 28. The system control 40 in response initiates counting of the encoder pulses at block 128 using the counter 74. From the pulses received at block 128, the system control 40 determines at block 130 the position of the substrate 28. As discussed herein, each pulse generated by the conveyor feedback device 34 directly translates into a degree of rotation and a distance useful in this location determination.

If not previously accomplished, the system control 40 receives, recalls or otherwise determines at block 132 an applicable operating parameter. Such a parameter may include $X_{on}$, $X_{off}$ and/or a pressure specification. As discussed herein, the operating parameter determined at block 132 may be recalled from memory and/or determined using information fed back from the adhesive sensor 80.

From the encoder pulses, the system control 40 determines if the substrate 28 is in a position associated with the determined operating parameter. If not, the system control 40 waits for the substrate 28 to continue to advance. Where the substrate 28 is alternatively in position according to the operating parameter determined at block 132, then the system control 40 sends a signal to the dispensing gun 22 at block 136.

The dispensing gun 22 initiates an adhesive application process at block 138. Such initiation processes include the gun 22 dispensing adhesive onto the substrate 28 in response to a command signal sent by the system control 40. As discussed herein, the dispensing process includes a switching delay period spanning from the time the gun receives the signal to the time it applies the adhesive at block 140 of FIG. 3.

The adhesive sensor 80 detects one or more measurable characteristics as applicable at block 142. Such measurable characteristics may include leading and trailing edges, as well as the volume of adhesive 72 applied to the substrate 28. As such, the detection of these measurable characteristics at block 142 may also include use of photocell, or down line trigger sensor 39 for the purpose of distinguishing the leading and trailing edges 108 and 112, respectively, of the substrate 28 from the adhesive 72.

The characteristic(s) detected at block 142 is communicated back to the system control 40 at block 132. The system control 40 then determines an appropriate signal parameter for use in generating a next occurring signal. The determination of the signal parameter at block 132 may include an adjustment to a current parameter according to feedback from block 142. This feature of the flowchart 120 thus provides adjustment of $X_{on}$, $X_{off}$ and/or adhesive pressure in real time. The real time adjustment may translate into less wasted substrate and other more efficient processing.

Figure 4:
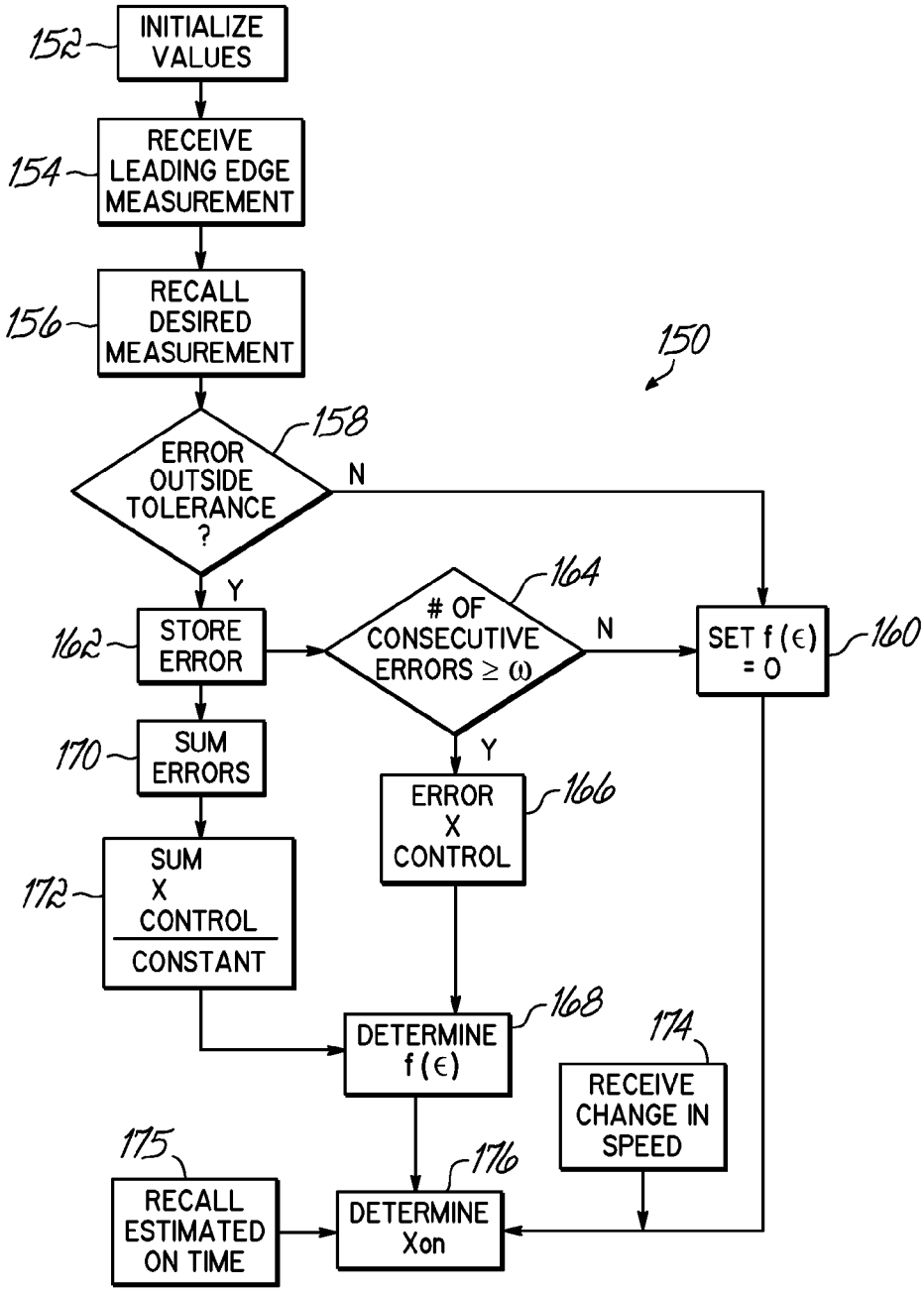
FIG. 4 is a flowchart showing in greater detail the processes used in FIG. 3 to determine on time compensation.

FIG. 4 is a flowchart 150 showing operating parameter determination processes as may be applicable in FIG. 3. More particularly, the processes of FIG. 4 have particular application within the determine signal parameter step 132 of FIG. 3. The flowchart 150 includes an exemplary sequence of steps executed by the system control 40 to determine $X_{on}$, or the on time compensation. In terms of FIG. 1, $X_{on}$ is ultimately communicated to the adhesive gun 22 via control signal 56.

The system control 40 initially receives and/or initializes baseline operating parameters at block 152 of FIG. 4. Such settings may include $X_{on}$ as recalled from memory 41 and/or as initially input using established estimates based on operator experience and/or historical equipment data. Other settings initialized at block 152 may include tolerances, a control/gain value and/or a number, ω, of consecutive errors needed to initiate an integral control function as described below in detail.

The system control 40 receives at block 154 a leading edge measurement. As discussed in the text describing FIG. 2, the leading edge characteristic measured at block 154 includes a distance measurement 110 that corresponds to the actual distance between a leading edge 108 of the substrate 102 and the leading edge of the applied adhesive 106.

At block 156 of FIG. 4, the system control 40 recalls from memory 43 a desired leading edge measurement. The system control 40 compares the desired measurement to the actual leading edge measurement at block 158. If the comparison reveals that the actual measurement is within an accepted standard deviation or other tolerance at block 158, then no change to the $X_{on}$ parameter is made. More particularly, a function $f(\in)$ used to determine $X_{on}$ will be set to zero at block 160.

If alternatively, the error determined from the comparison of block 158 is outside of the accepted tolerance, that error is stored by the system control 40 within memory 43 at block 162 of FIG. 4. Detection of a single error outside of the tolerance at block 158 initiates a proportional control path process that includes block 164 of FIG. 4. The system control 40 at block 164 determines if, including this latest error at block 158, the number of consecutive errors is now greater than or equal to ω. As discussed herein, ω comprises a predetermined number set back at block 152. If the number of consecutive errors is less than ω at block 164, then $f(\in)$ is set to zero at block 160 and no change is made to $X_{on}$.

If the number of consecutive errors at block 164 is alternatively greater than or equal to ω, then the value of the determined error is multiplied by a control value at block 166. Like ω, the control value is typically one of the values initialized at block 152. The product of block 166 of FIG. 4 is used, in part, to determine f(∈) for a next occurring cycle. Such a cycle may include a next presented substrate, for instance.

The determination at block 158 that an error is outside of an acceptable tolerance additionally prompts the summation at block 170 of all errors stored within a given period. Block 170, as such, includes a portion of an integral control path shown in FIG. 4.

More particularly, the summation of errors accomplished by the system control 40 at block 170 is multiplied by the quotient of the control value, divided by a constant, e.g., 500. The constant may be largely arbitrary, preset at block 152, and is typically large relative to the control constant. The product of block 172 is used by the system control 40 at block 168 to help determine f(∈). The system control 40 specifically determines f(∈) at block 168 by summing the respective products of block 166 and block 172. As noted above, however, f(∈) is set to zero when applicable at block 160, irrespective of any product determined at block 172.

Where desired, the system control 40 may also take into account a change in conveyor speed when determining f(∈). To this end, a conveyor signal generated by the conveyor feedback device 34 is received at block 174. Such processes at block 174 may include determining if a change in speed has occurred by comparing stored and current encoder counts. An estimated on time is recalled at block 175. The on time corresponds to the time it is expected to take for the inactive gun 22 to begin dispensing from the time it receives the command signal. For example, a typical on time may be around 5 ms.

In any case, the system control 40 may use the appropriate inputs, such as the estimated on time of the dispensing gun 22, f(∈) and any change in conveyor speed to determine the new $X_{on}$ ($X_{on}^{(k+1)}$) at block 176 of FIG. 4. This $X_{on}$ determination is accomplished using the following equation:

$$X_{on}^{(k+1)}=X_{on}^{(k)}+f(\in)+\text{estimated on time}\times\text{change in speed.}$$

Of note, $X_{on}^{(k+1)}$ in the above equation is the newly determined $X_{on}$ for the next occurring dispensing operation. Accordingly, $X_{on}^{(k)}$ in terms of the above equation is the $X_{on}$ value for the previous operation or the baseline value. Moreover, the determined f(∈) value may include a positive or a negative value.

This $X_{on}$ determination is thus used by the system control 40 to affect bead placement on a next-occurring cycle. In this sense, an embodiment consistent with the principles of the present invention achieves real time feedback that reduces substrate waste and increases efficiency.

Figure 5:
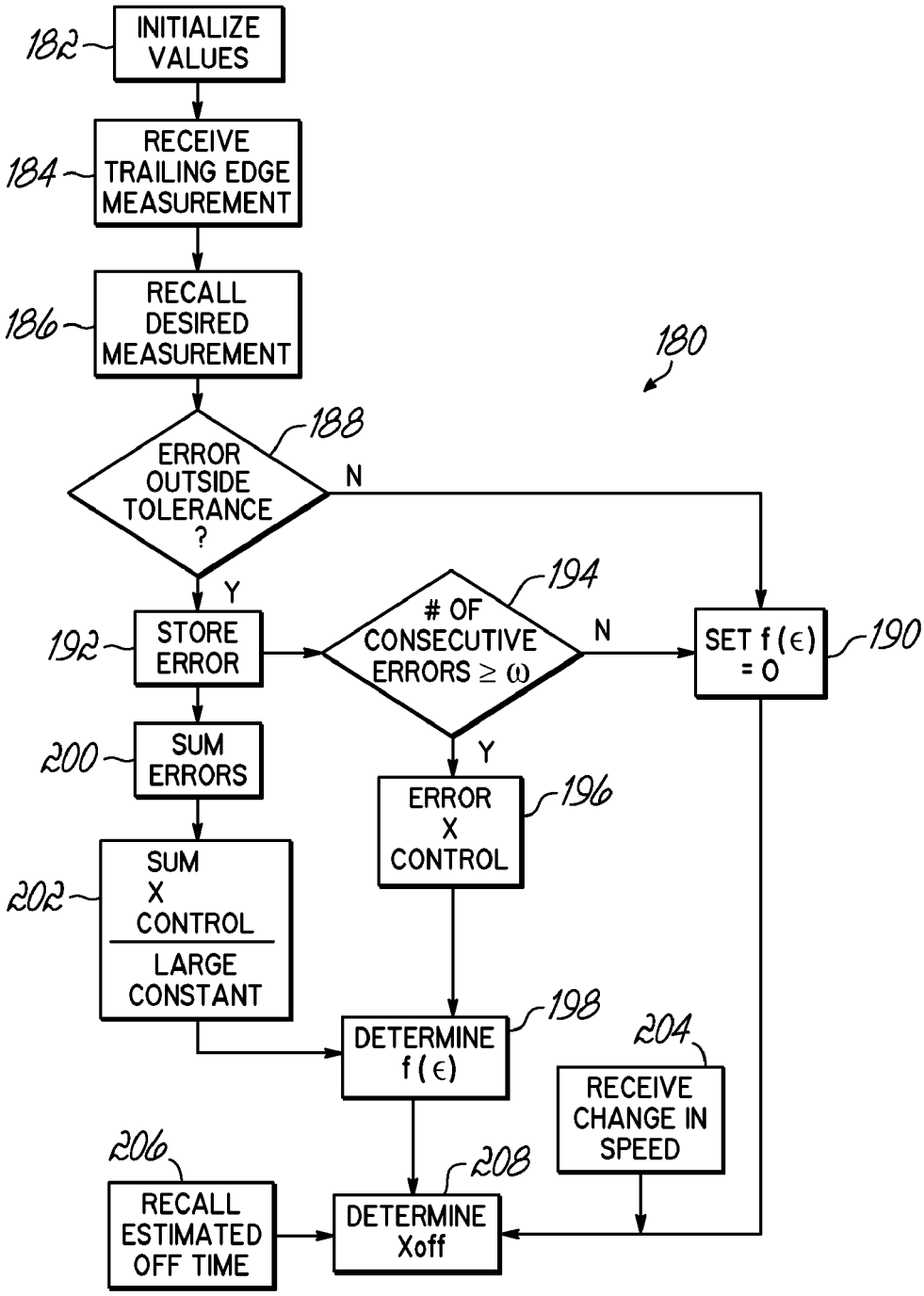
FIG. 5 is a flowchart showing in greater detail the processes used in FIG. 3 to determine off time compensation.

FIG. 5 includes a flowchart 180 for determining $X_{off}$. $X_{off}$ corresponds to the distance from the glue gun 22 at which the gun 22 should initiate processes to stop applying the adhesive in order for the adhesive to be placed properly on the substrate 28. The processes of FIG. 5 have particular application within the determine signal parameter step 132 of FIG. 3.

Turning more particularly to block 82 of FIG. 5, the system control 40 may initialize certain values, including control and ω values, as well as an estimated off time and an estimated and/or recalled $X_{off}$. Such an initial $X_{off}$ value may be initially input by a user from estimates, or may be recalled from memory 43 by the system control 40. The $X_{off}$ value may alternatively correspond to a $X_{off}$ value determined during a previous feedback cycle.

At block 184, the system control 40 receives a trailing edge measurement from the adhesive sensor 80. As discussed in the text describing FIG. 2, the trailing edge measurement may correspond to a distance 114 from an edge 112 of the substrate 102 to the end of the bead of adhesive 106. The system control 40 recalls a desired trailing edge measurement at block 186. A comparison between the desired and actual measurements is accomplished by the system control 40 at block 188. Should any error determined at block 188 be within a specified tolerance, f(∈) is set to zero at block 190. This zero setting by the system control 40 translates into no change in any subsequent $X_{off}$ value.

If the determined error alternatively falls outside of the specified tolerance at block 188, then that error associated with $X_{off}$ is stored at block 192. Should this stored error at block 192 comprise one of a number of consecutive errors at block 194 that are greater than or equal to ω, the error stored at block 192 is multiplied by a control value at block 196. The product of block 196 is used at block 198 to used to determine f(∈) as discussed below.

Should the error detected at block 188 alternatively not comprise a number of consecutive errors greater than or equal to ω, then f(∈) is set to zero at block 190, and $X_{off}$ remains unchanged at block 208.

As part of an integral control feature, the error stored at block 192 is summed with other errors at block 200 of FIG. 5. The sum of these errors is multiplied by the quotient of the control value divided by a constant at block 202. The product of the sum and the quotient at block 202 is used at block 198 to determine f(∈). More particularly, the system control 40 may determine f(∈) by summing the respective products of block 202 and block 196. As noted above, however, f(∈) is set to zero when applicable at block 190, irrespective of any product determined at block 202.

This determination of f(∈) of block 198 is used, in part, to determine $X_{off}$ at block 208. Other factors used to determine $X_{off}$ at block 208 include any determined change of conveyor speed at block 204 and an estimated off time of the dispensing gun 22 recalled at block 206. Off time corresponds to the time it is expected to take for the actively dispensing gun 22 to cease dispensing from the time it receives the command signal. For example, a typical off time may be around 6 ms. As such, the system control 40 may determine a new $X_{off}$ ($X_{off}^{(k+1)}$) according to the following equation:

$$X_{off}^{(k+1)}=X_{off}^{(k)}+f(\in)+\text{estimated off time}\times\text{change in speed.}$$

This $X_{off}$ determination is used by the system control 40 to affect bead placement on a next-occurring cycle and in so doing, achieves real time feedback that reduces substrate waste and increases efficiency.

Figure 6:
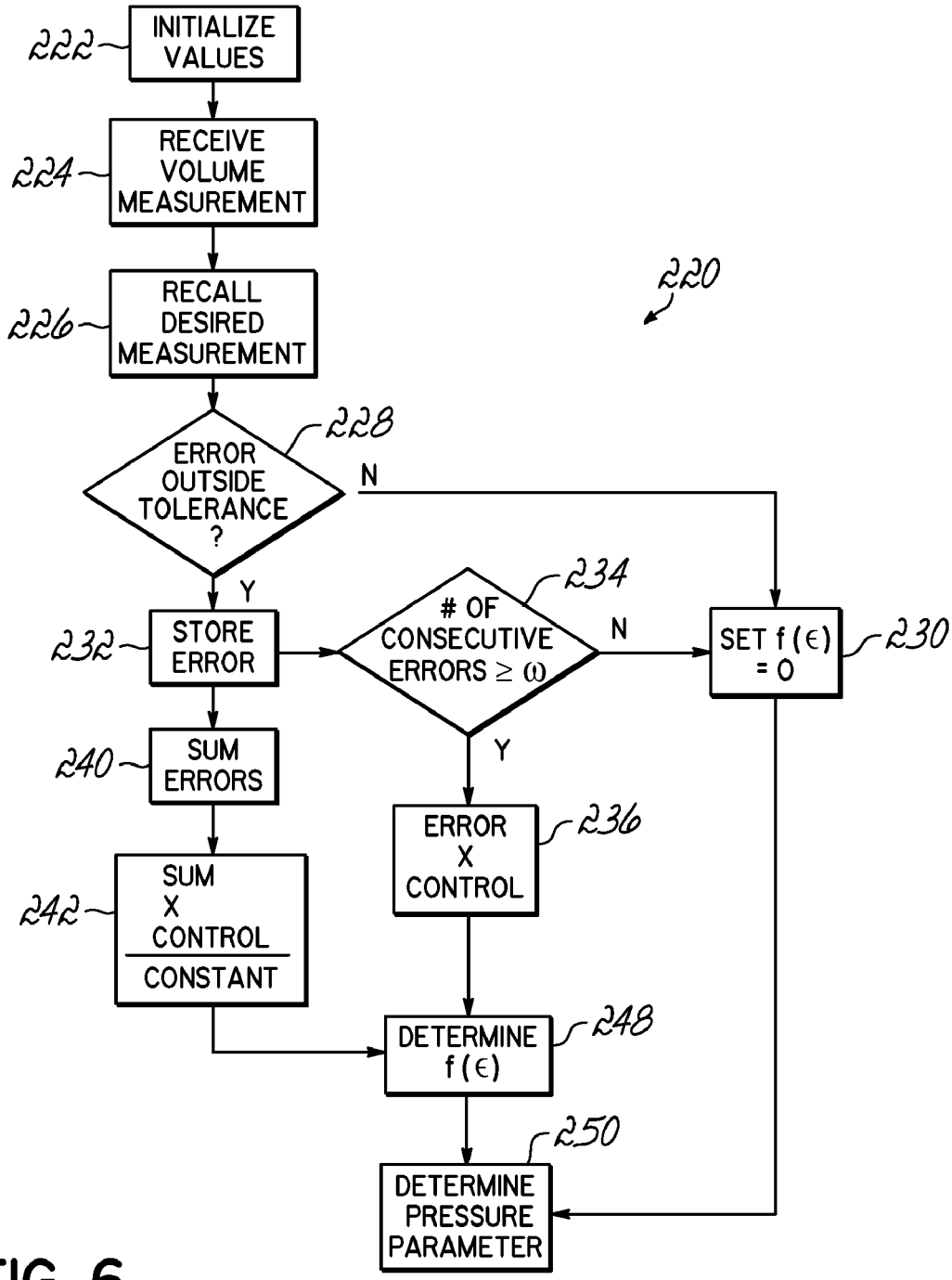
FIG. 6 is a flowchart showing in greater detail the processes used in FIG. 3 to determine volume compensation.

FIG. 6 is a flowchart 220 for determining a pressure operating parameter used to determine a signal in FIG. 3 that affects an adhesive dispensing operation. More specifically, the processes of the flowchart 220 may have particular application in determining the operating parameter described at block 132 of FIG. 3. Adjustment to pressure on the fluid may be accomplished using an electronic pressure regulator, as is common in the industry.

Turning more particularly to block 222 of FIG. 6, several values may be initialized by a user and/or the system control 40. Such values may include a desired volume measurement characteristic, as well as an error tolerance value. For instance, a desired volume for the bead shown in FIG. 2 includes 0.04 milliliters.

The system control 40 receives at block 224 an actual volume measurement, or volume characteristic. The actual volume measurement may be determined and communicated by the adhesive sensor 80 as discussed herein. The system control 40 compares at block 228 the actual measurement to the desired measurement, which is recalled at block 226. If any determined error at block 228 falls within the specified tolerance for error, then f(∈) is set to zero at block 230. This setting will translate into no change to the pressure parameter determined at block 250. Similarly, f(∈) is set to zero where a number of errors received consecutively does not exceed or equal ω.

Where the number of consecutive errors alternatively does equal or exceed ω, the error determined at block 228 and stored at block 232 is multiplied by a control value at block 236. This multiplication at block 236 comprises part of a proportional control path. The product of the error and control value at block 236 is used by the system control 40 at block 248 to determine f(∈).

As part of a parallel integral control path at block 240, the errors determined outside of a tolerance are summed and multiplied at block 242 by the quotient of the control value divided by the number of errors summed. The product of block 242 is used by the system control 40 at block 248 to determine f(∈). For instance, both products may be added together to determine f(∈).

The system control 40 then determines the new pressure parameter ($X_{pressure}^{(k+1)}$) at block 250 using the determine f(∈) value according to the following equation:

$$X_{pressure}^{(k+1)}=X_{pressure}^{(k)}+f(\in).$$

While the present invention has been illustrated by a description of various embodiments and while these embodiments have been described in considerable detail in order to describe a mode of practicing the invention, it is not the intention of Applicant to restrict or in any way limit the scope of the appended claims to such detail. One skilled in the art will appreciate, for instance, that another embodiment that is consistent with the principles of the present invention may use a pair of photodetectors or other sensors to determine the speed and location of an edge or other part of the substrate irrespective of the presence of an encoder. Such an embodiment capitalizes on known substrate speeds and fixed distances to determine a relevant operating parameter in a time-based (as opposed to a distance-based) implementation. Additional advantages and modifications within the spirit and scope of the invention will readily appear to those skilled in the art. For example, while the counter 74 and comparator 76 are shown in FIG. 1 as being separate from the microprocessor 42, one skilled in the art will appreciate that their respective functionalities may be included within and/or comprise a controller of another embodiment. Moreover, a control for purposes of the specification and claims may include counters, processors, gun drivers and/or microprocessors.

What is claimed is:

1. An apparatus for operating a fluid dispensing gun to dispense fluid onto a substrate moving relative to the dispensing gun, the dispensing gun having a first operating state and second operating state and requiring a switching time to change from the first operating state to the second operating state, the apparatus comprising:

a sensor for producing a sensor feedback signal used to determine a difference between an actual adhesive positional characteristic and a desired adhesive positional characteristic; and a control responsive to said sensor feedback signal and configured to determine if said difference falls outside of a desired tolerance, and if so, the control being further configured to use at least one of proportional, integral and derivative control processes to automatically adjust a command signal that initiates a change from the first operating state to the second operating state;

wherein said control is further operative to determine if said difference comprises one of a plurality of consecutive differences falling outside of said desired tolerance.

2. The apparatus of claim 1 wherein said control is configured to perform at least one the following:

(a) to send said command signal configured to initiate said change of state to the dispensing gun;

(b) to adjust said command signal by determining an operating parameter selected from at least one of on time compensation and off time compensation;

(c) to store said difference;

(d) to adjust said command signal by determining on time compensation according to: $X_{on}^{(k+1)}=X_{on}^{(k)}+f(\in)+$an estimated on time×a change in conveyor speed; and (e) to adjust said command signal by determining off time compensation according to: $X_{off}^{(k+1)}=X_{on}^{(k)}+f(\in)+$an estimated on time×a change in conveyor speed.

3. The apparatus of claim 1 wherein said difference is determined by comparing said actual positional characteristic to said desired positional characteristic, wherein said actual positional characteristic is selected from a group consisting of at least one of: a distance from an edge of a substrate to a start of a bead, a distance from an edge of a substrate to an end of a bead and a bead length.

4. The apparatus of claim 1 wherein said control is operative to sum said difference with another difference.

5. The apparatus of claim 4 wherein said control is operative to multiply said sum of said differences by a quotient that includes a control value divided by a constant.

6. The apparatus of claim 1 wherein said control is operative to multiply said difference by a control value.

7. The apparatus of claim 1 wherein said control is operative to adjust said command signal by processing a value selected from a group consisting of at least one of: an estimated off time, an estimated on time, a stored on time compensation, a stored off time compensation and a change in conveyor speed.

8. The apparatus of claim 1 wherein said control is operative to adjust said command signal by processing a pressure parameter.

9. The apparatus of claim 1 wherein said sensor is operative to produce said sensor feedback signal in response to sensing a presence of adhesive deposited on a substrate by the fluid dispensing gun.

10. The apparatus of claim 9 wherein said sensor is operative to produce said sensor feedback signal in response to sensing at least one of a leading edge of a fluid deposited on a substrate by the fluid dispensing gun and a trailing edge of a fluid deposited on a substrate by the fluid dispensing gun.

11. The apparatus of claim 1 further comprising a position feedback device operative to determine a position of at least one of a substrate and said actual adhesive positional characteristic.

12. An apparatus for operating a fluid dispensing gun to dispense fluid onto a substrate moving relative to the dispensing gun, the dispensing gun having a first operating state and second operating state and requiring a switching time to change from the first operating state to the second operating state, wherein a command signal initiates a change from said first operating state to said second operating state, the apparatus comprising:

a sensor for producing a sensor feedback signal used to determine a difference between an actual adhesive positional characteristic and a desired adhesive positional characteristic; and a control responsive to said sensor feedback signal and configured to determine if said difference is one of a plurality of values that fall outside of a desired tolerance, and if so, said control being further configured to automatically adjust said command signal.

13. The apparatus of claim 12 wherein said plurality of values is a plurality of consecutive differences that each fall outside of said desired tolerance.

14. The apparatus of claim 12 wherein said control is operative to do one of the following:

(a) to adjust said command signal by determining an operating parameter selected from at least one of on time compensation and off time compensation; and (b) to multiply said difference by a control value.

15. The apparatus of claim 12 wherein said control is operative to adjust said command signal by processing a value selected from a group consisting of at least one of: an estimated off time, an estimated on time, a stored on time compensation, a stored off time compensation and a change in conveyor speed.

16. The apparatus of claim 12 wherein said control is operative to adjust said command signal by processing a pressure parameter.

17. The apparatus of claim 16 wherein said control is operative to adjust said command signal by determining said pressure parameter according to:

$$X_{pressure}^{(k+1)}=X_{pressure}^{(k)}+f(\in).$$

* * * * *

UNITED STATES PATENT AND TRADEMARK OFFICE

CERTIFICATE OF CORRECTION

PATENT NO. : 7,954,451 B2
APPLICATION NO. : 12/046797
DATED : June 7, 2011
INVENTOR(S) : Richard G. Klein It is certified that error appears in the above-identified patent and that said Letters Patent is hereby corrected as shown below:

Column 1
Line 42, reads "move 0.008 inches" and should read -- move 0.008 inch --.

Column 1
Line 44, reads "0.002 inches" and should read -- 0.002 inch --.

Column 6
Lines 22-25, read "Detection by the down line sensor 39 is accomplished prior to measurements of applicable characteristics are accomplished by the adhesive sensor 80." and should read -- Detection by the down line sensor 39 is accomplished prior to measurements of applicable characteristics being accomplished by the adhesive sensor 80. --.

Column 7
Line 40, reads "$X_{off}$may represent" and should read -- $X_{off}$ may represent --.

Column 8
Line 46, reads "the signal used adjust the command signal is" and should read -- the signal used to adjust the command signal is --.

Column 9
Line 32, reads "a pressure operating parameters" and should read -- pressure operating parameters --.

Column 12
Line 14, reads "is used at block 198 to used to determine" and should read -- is used at block 198 to determine --.

Column 12
Line 60, reads "0.04 milliliters" and should read -- 0.04 milliliter --.

Signed and Sealed this
Eighteenth Day of October, 2011

David J. Kappos

David J. Kappos
*Director of the United States Patent and Trademark Office*

Column 14
Line 5, Claim 2, reads “perform at least one the following” and should read -- perform at least one of the following --.

Column 14
Line 14, Claim 2, reads “estimated on time×a change in” and should read -- estimated on time × a change in --.

Column 14
Line 16, Claim 2, reads “= $X_{on}$” and should read -- = $X_{off}$ --.

Column 14
Line 17, Claim 2, reads estimated on time×a change in” and should read -- estimated on time × a change in --.